US012325604B2

(12) United States Patent
Kim et al.

(10) Patent No.: US 12,325,604 B2
(45) Date of Patent: Jun. 10, 2025

(54) REWINDING SYSTEM

(71) Applicants: SAMSUNG SDI CO., LTD., Yongin-si (KR); EDS CO., Ltd., Gumi-si (KR)

(72) Inventors: Myung Gi Kim, Cheonan-si (KR); Hyun Seok Lee, Yongin-si (KR)

(73) Assignees: SAMSUNG SDI CO., LTD., Yongin-si (KR); EDS CO., Ltd, Gumi-si (KR)

( * ) Notice: Subject to any disclaimer, the term of this patent is extended or adjusted under 35 U.S.C. 154(b) by 94 days.

(21) Appl. No.: 17/785,159

(22) PCT Filed: Nov. 26, 2020

(86) PCT No.: PCT/KR2020/016984
§ 371 (c)(1),
(2) Date: Jun. 14, 2022

(87) PCT Pub. No.: WO2021/145556
PCT Pub. Date: Jul. 22, 2021

(65) Prior Publication Data

US 2023/0356971 A1 Nov. 9, 2023

(30) Foreign Application Priority Data

Jan. 14, 2020 (KR) ..... 10-2020-0004994

(51) Int. Cl.
*B65H 19/20* (2006.01)
*B65H 19/22* (2006.01)
*B65H 19/26* (2006.01)

(52) U.S. Cl.
CPC ..... *B65H 19/2215* (2013.01); *B65H 19/20* (2013.01); *B65H 19/26* (2013.01); *B65H 2701/11332* (2013.01); *B65H 2701/37* (2013.01)

(58) Field of Classification Search
CPC .... B65H 5/22; B65H 19/262; B65H 19/2215; B65H 19/12; B65H 19/30; B65H 19/20;
(Continued)

(56) References Cited

U.S. PATENT DOCUMENTS 4,529,141 A * 7/1985 McClenathan .... B65H 19/2215 242/532.3
4,909,452 A * 3/1990 Hertel ..... B65H 19/2269 242/541.5
5,735,481 A * 4/1998 Loosen ..... B65H 19/2223 242/532.3
(Continued)

FOREIGN PATENT DOCUMENTS

CN 1355751 A 6/2001
CN 102259771 A 11/2011
(Continued)

OTHER PUBLICATIONS

Chinese Notice of Allowance dated Nov. 30, 2023, of the Chinese Patent Application No. 202080089436.6.
(Continued)

*Primary Examiner* — Emmanuel M Marcelo
*Assistant Examiner* — Henrix Soto
(74) *Attorney, Agent, or Firm* — Lee IP Law, P.C.

(57) ABSTRACT

A rewinding system includes a rewinding apparatus for winding a manufactured thin-film tape on a re-winding roll; a loading apparatus for loading the re-winding roll on which the thin-film tape is rewound; and a cutting apparatus for cutting the thin-film tape. The rewinding apparatus includes first and second mounting members in which re-winding rolls are inserted; and a connecting member connected to an end of each of the first and second mounting members to move the first and second mounting members. The first mounting member rotates around a shaft thereof, the second mounting member rotates around a shaft thereof, and the connecting member rotates the first and second mounting
(Continued)

members to change positions of the first and second mounting members, and moves at least one of the first and second mounting members to the place where the loading apparatus is arranged.

8 Claims, 13 Drawing Sheets

(58) Field of Classification Search
CPC ..... B65H 19/26; B65H 2301/4181; B65H 2301/418; B65H 2301/4189; B65H 2301/4148; B65H 2301/41426; B65H 2301/51537; B65H 2408/2313; B65H 2408/23152; B65H 2408/232; B65H 2408/2223
USPC ..... 242/522
See application file for complete search history.

(56) References Cited

U.S. PATENT DOCUMENTS

| | | | | | |
|---|---|---|---|---|---|
| 5,810,966 | A * | 9/1998 | Semba | B65H 19/2215 156/530 |
| 5,845,867 | A * | 12/1998 | Hould | B65H 19/2223 242/527.2 |
| 6,276,116 | B1 | 8/2001 | Annila et al. | |
| 7,631,832 | B1 | 12/2009 | Chen | |
| 7,896,283 | B2 | 3/2011 | Tauber et al. | |
| 10,329,111 | B2 | 6/2019 | Sato et al. | |
| 2008/0223973 | A1* | 9/2008 | Endo | B65H 19/26 242/412.1 |
| 2017/0137251 | A1 | 5/2017 | Sato et al. | |

FOREIGN PATENT DOCUMENTS

| | | | | | |
|---|---|---|---|---|---|
| CN | 104444505 | A | | 3/2015 | |
| CN | 106458490 | A | | 2/2017 | |
| CN | 107032104 | A | * | 8/2017 | B65G 47/74 |
| CN | 108046019 | A | * | 5/2018 | B65H 19/26 |
| CN | 208959329 | U | | 6/2019 | |
| DE | 102011007092 | A1 | * | 10/2012 | B65H 18/20 |
| EP | 1162164 | A1 | | 5/2001 | |
| JP | 2558535 | B2 | * | 11/1996 | |
| JP | 2002240997 | A | * | 8/2002 | |
| JP | 2004189355 | A | * | 7/2004 | |
| JP | 2005-320107 | A | | 11/2005 | |
| KR | 10-0145960 | B1 | | 5/1998 | |
| KR | 10-2005-0080209 | A | | 8/2005 | |
| KR | 100880394 | B1 | * | 1/2009 | |
| KR | 10-1171173 | B1 | | 8/2012 | |
| KR | 10-1431784 | B1 | | 8/2014 | |
| KR | 10-1443119 | B1 | | 9/2014 | |
| KR | 10-1553167 | B1 | | 9/2015 | |
| KR | 10-2145059 | B1 | | 9/2020 | |
| WO | WO-2018122542 | A1 | * | 7/2018 | B65H 19/1821 |
| WO | WO-2018150114 | A1 | * | 8/2018 | B29C 48/0022 |

OTHER PUBLICATIONS

Chinese Office Action issued Mar. 31, 2023.
International Search Report dated Feb. 3, 2021 for PCT/KR2020/016984.
Extended European Search Report dated Aug. 9, 2024 for corresponding European Patent Application No. 20914269.4.

* cited by examiner

REWINDING SYSTEM

CROSS REFERENCE TO RELATED APPLICATIONS

This is the U.S. national phase application of PCT Application No. PCT/KR2020/016984 filed on Nov. 26, 2020, which is based on Korean Patent Application No. 10-2020-0004994, filed on Jan. 14, 2020, the entire contents of all of which are hereby incorporated by reference.

TECHNICAL FIELD

The present disclosure relates to a rewinding system having improved process efficiency.

BACKGROUND ART

With the development and demand for slim and small electronic devices, such as smart phones, tablets, laptops, and the like, thin-film tapes for various purposes, such as adhesion, insulation, and electrical connection between components in each electronic device are being used.

Thin-film tapes being manufactured are manufactured in a primary form of being wound on a roll. However, each electronic device needs to be processed to the size and length required according to the manufacturing process thereof, and a secondary processing for winding the thin-film tapes on a new roll is required.

Recently, a rewinding apparatus for newly winding a manufactured thin-film tape according to the needs of users and processes is used. In addition, the manufacturing efficiency of the entire process, including secondary processing, varies according to the process efficiency of a rewinding apparatus, and thus the efficiency of a rewinding apparatus for newly winding a manufactured thin-film tape is quite important the efficiency of a rewinding apparatus for newly winding a manufactured thin-film tape is quite important.

DESCRIPTION OF EMBODIMENTS

Technical Problem

The purpose of the present disclosure is to provide a rewinding system having improved process efficiency.

Solution to Problem

The present disclosure for achieving the above purpose provides a rewinding system, comprising: a rewinding apparatus for winding a manufactured thin-film tape on a re-winding roll; a loading apparatus for loading the re-winding roll on which the thin-film tape is rewound; and a cutting apparatus for cutting the thin-film tape, wherein: the rewinding apparatus comprises a first mounting member and a second mounting member in which a plurality of re-winding rolls are inserted, and a connecting member connected to an end of the first mounting member and an end of the second mounting member to move the first mounting member and the second mounting member; the first mounting member rotates around a shaft thereof, and the second mounting member rotates around a shaft thereof and the connecting member rotates the first mounting member and the second mounting member to change positions of the first mounting member and the second mounting member, and moves at least one of the first mounting member and the second mounting member to the place where the loading apparatus is arranged.

The connecting member may include a rotation plate, and a first interlocking member and a second interlocking member connected to the rotating plate and one surface of the rotating plate to independently rotate and move the first and second mounting members, respectively, and the first interlocking member includes a rotation member for rotating the first mounting member about the shaft of the first mounting member, and shaft moving members disposed at both ends of the rotation member to be perpendicular to the shaft of the first mounting member to move the rotation member in the horizontal direction.

The rewinding apparatus may repeatedly operate: a first state in which, while the thin-film tape is being rewound on the plurality of re-winding rolls inserted into the first mounting member, the second mounting member into which the plurality of re-winding rolls on which the thin-film tape is rewound is moved to a place where the loading apparatus is located; a second state in which, after the plurality of re-winding rolls on which the thin-film tape inserted into the second mounting member is rewound is loaded in the loading apparatus, the second mounting member is moved back to a place adjacent to the first mounting member; a third state in which, after the thin-film tape is rewound on the plurality of re-winding rolls inserted into the first mounting member, the positions of the first mounting member and the second mounting member are changed; a fourth state in which, while the thin-film tape is being rewound on the plurality of re-winding rolls inserted into the second mounting member, the first mounting member into which the plurality of re-winding rolls on which the thin-film tape is rewound are inserted is moved to a place where the loading apparatus is located; and a fifth state in which, after the plurality of re-winding rolls on which the thin-film tape inserted into the first mounting member is rewound are loaded in the loading apparatus, the first mounting member is moved back to a place adjacent to the second mounting member.

The cutting apparatus may include a roller part, disposed on the first mounting member or the second mounting member to be rewound, for rolling an outer circumferential surface of the thin-film tape wound on the re-winding roll, an adsorption part for vacuum-adsorbing the tape rolled by the roller part, a fixing part for selectively fixing the thin-film tape adsorbed to the adsorption part, and a blade that slidably moves so as to be adjacent to one surface of the adsorption part in order to cut the thin-film tape.

The adsorption part may include a contact portion being in contact with the thin-film tape, and an adsorption space that is stepped with respect to the contact portion and adsorbs and fixes one surface of the thin-film tape, and the fixing part may move between a spaced-apart state from the adsorption part and a fixed state in which the upper surface thereof is in contact with the lower surface of the thin-film tape being in contact with the contact portion.

The rewinding system may further include a loading guide apparatus disposed between the rewinding apparatus and the loading apparatus and arranged to connect the loading apparatus with at least one of the first and second mounting members having moved adjacent to the loading apparatus, wherein the loading guide apparatus comprises: a support part for supporting the other end of at least one of the first mounting member and the second mounting member having moved adjacent to the loading apparatus to horizontally maintain the other end of at least one of the first mounting member and the second mounting member; and a guide moving part for adjusting the horizontality of the other end of at least one of the first mounting member and the second mounting member having moved adjacent to the loading apparatus by vertically and horizontally moving the support part.

The loading apparatus may include a loading member into which the other end of at least one of the first mounting member and the second mounting member can be inserted, wherein, in a state in which the other end of at least one of the first mounting member and the second mounting member is inserted and connected to the loading member, the support part guides the plurality of re-winding rolls on which the thin-film tape is rewound to be pushed in a direction in which the loading member is located.

The rewinding apparatus may rotate the first mounting member and the second mounting member in the same direction as a direction in which the first mounting member rotates about the shaft of the first mounting member to change the positions of the first mounting member and the second mounting member.

The rewinding apparatus may further include a rail part connected to upper and lower sides thereof to horizontally move the rewinding apparatus.

BEST MODE

In order to fully understand the configuration and effect of the present disclosure, preferred embodiments of the present disclosure will be described with reference to the accompanying drawings. However, the present disclosure is not limited to the embodiments disclosed below, and may be implemented in various forms and various changes may be made. However, the description of the present embodiments is provided so that the disclosure of the present disclosure is complete, and to fully inform those of ordinary skill in the art to which the present disclosure belongs, the scope of the invention. In the accompanying drawings, for convenience of explanation, sizes of various components are enlarged exaggerated the components are enlarged from actuality, and the proportions of the respective components may be exaggerated or reduced.

It will be understood that when an element is referred to as being "on" or "adjacent to" another element, another element may be directly abutting on or connected to the other element, but another element may be present therebetween. However, it will be understood that when an element is referred to as being "directly on" or "in direct contact with" another component, another element may not be present therebetween. Other expressions describing the relationship between elements, for example, "between" and "directly between", etc. may be interpreted similarly.

It will be understood that, although the terms first, second, etc. may be used herein to describe various members, elements, regions, layers and/or sections, these members, elements, regions, layers and/or sections should not be limited by these terms. These terms are only used to distinguish one member, element, region, layer and/or section from another. Thus, for example, a first member, a first element, a first region, a first layer and/or a first section discussed below could be termed a second member, a second element, a second region, a second layer and/or a second section without departing from the teachings of the present disclosure.

The singular expression includes the plural expression unless the context clearly dictates otherwise. Terms such as "comprises" or "have" are intended to designate that a feature, number, step, action, component, part, or combination thereof described in the specification exists, and may be construed as being capable of adding one or more other features or numbers, steps, operations, components, parts, or combinations thereof.

Unless otherwise defined, terms used in the embodiments of the present disclosure may be interpreted as meanings commonly known to a person skilled in the art.

Hereinafter, a rewinding system 1 and a rewinding apparatus 100, according to an embodiment of the present disclosure, will be described with reference to FIGS. 1 to 3.

Figure 1:
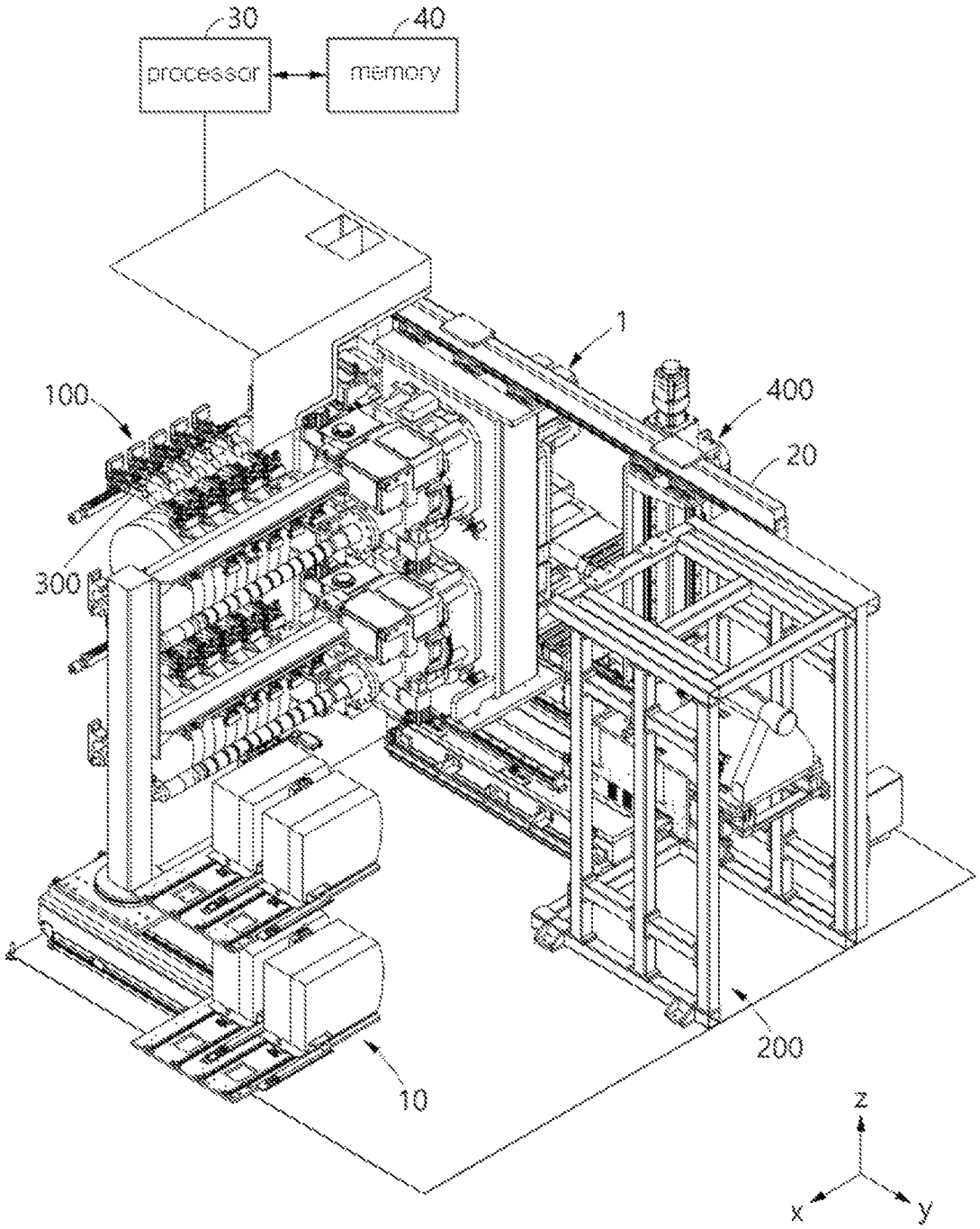
FIG. 1 is a perspective view showing a rewinding system according to an embodiment of the present disclosure.

FIG. 1 is a perspective view showing a rewinding system 1 according to an embodiment of the present disclosure. FIG. 2 is a perspective view illustrating a rewinding apparatus 100 according to an embodiment of the present disclosure. FIG. 3 is an enlarged view illustrating a region A of FIG. 2.

The rewinding system 1 may wind a manufactured thin-film tape on a new roll according to the needs of users and processes and load the rewound roll into a loading apparatus at the same time.

Specifically, the rewinding system 1 may include a rewinding apparatus 100 for winding a manufactured thin-film tape T (see FIG. 8) on re-winding rolls R1 and R2, a loading apparatus 200 for loading the re-winding rolls R1 and R2 on which the thin-film tape T is rewound, and a cutting apparatus 300 for cutting the thin-film tape T.

Here, the rewinding system 1 may further include a plurality of rewinding apparatuses 100. For example, referring to FIG. 12, the rewinding system 1 may include a first rewinding apparatus 100-1 and a second rewinding apparatus 100-2.

However, the first rewinding apparatus 100-1 and the second rewinding apparatus 100-2 may be disposed vertically with respect to each other and may move independently. The first rewinding apparatus 100-1 and the second rewinding apparatus 100-2 have the same structure, and thus, for convenience of description, the following description will focus on one rewinding apparatus 100.

In addition, the rewinding system 1 may include a processor 30 and a memory 40. The processor 30 may be included in the rewinding system 1 to perform overall control of the rewinding system 1. For example, the processor 30 may be connected to the rewinding apparatus 100, the loading apparatus 200, the cutting apparatus 300, and the loading guide apparatus 400 to control the respective apparatuses. That is, the operations and controls of the respective apparatuses, which will be described below, may be performed by the processor 30.

Here, the processor 30 may include a central processing unit (CPU), a controller, an application processor (AP), or one or more of a communication processor (CP) and an ARM processor.

The memory 40 is embedded in the rewinding system 1 and may be configured as a memory. Specifically, the memory 40 may be implemented as at least one of a flash memory type, ROM, RAM, a hard disk type, a multimedia card micro type, a card type memory (e.g., SD or XD memory, etc.).

Accordingly, the memory 40 may store a user's preset operation of the rewinding system 1 to store the operations and control processes of the rewinding system 1.

In addition, the rewinding system 1 may include a sensor (not shown) for measuring the plurality of re-winding rolls R1 and R2. Accordingly, by comparing the data value measured by the sensor with the data values stored in the memory 40, the defective state of the thin-film tape T wound on the plurality of re-winding rolls R1 and R2 can be checked in real time. That is, the rewinding system 1 may perform real-time vision inspection on the thin-film tape T by means of the sensor (not shown).

Figure 2:
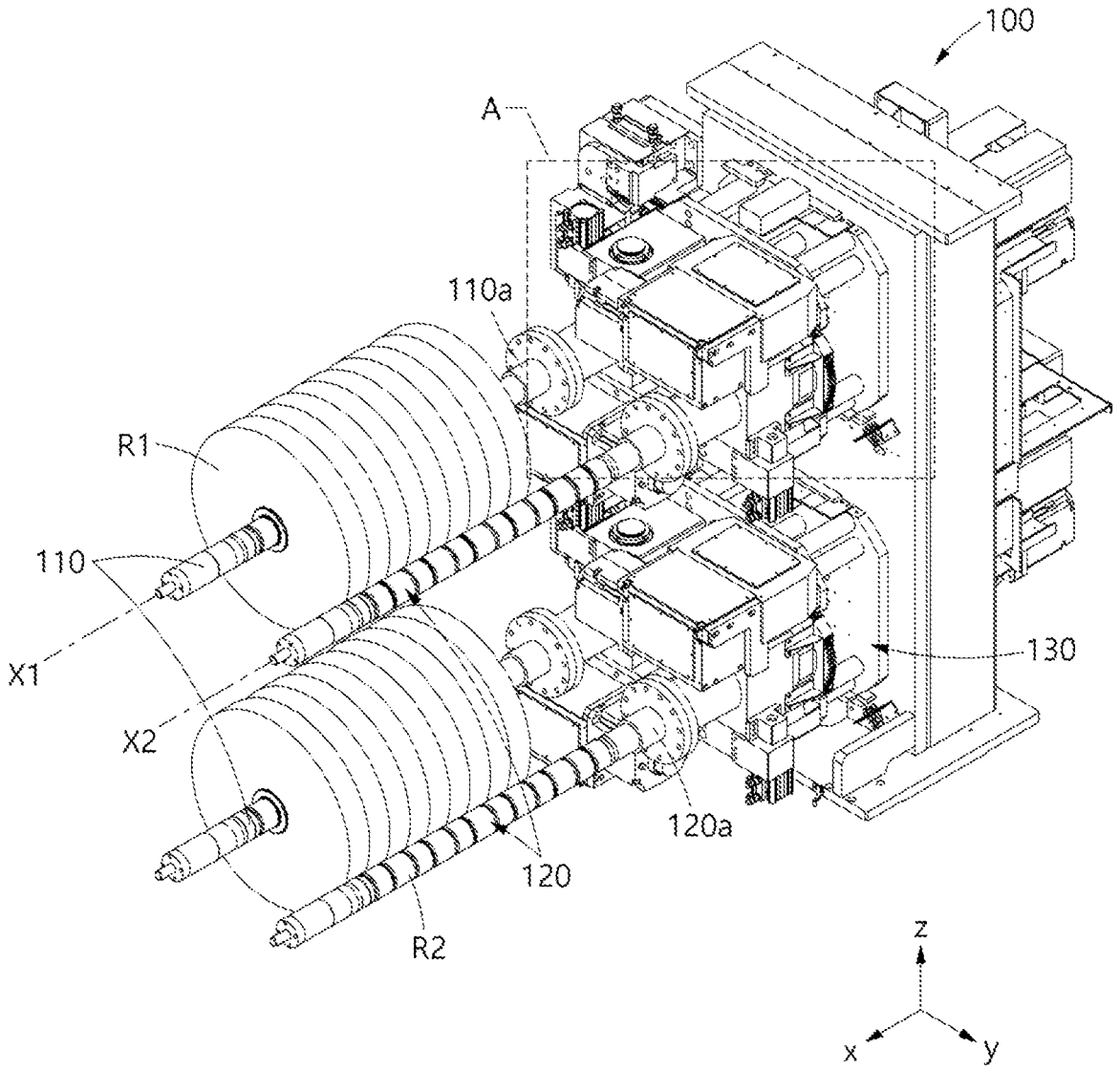
FIG. 2 is a perspective view illustrating a rewinding apparatus according to an embodiment of the present disclosure.
Figure 3:
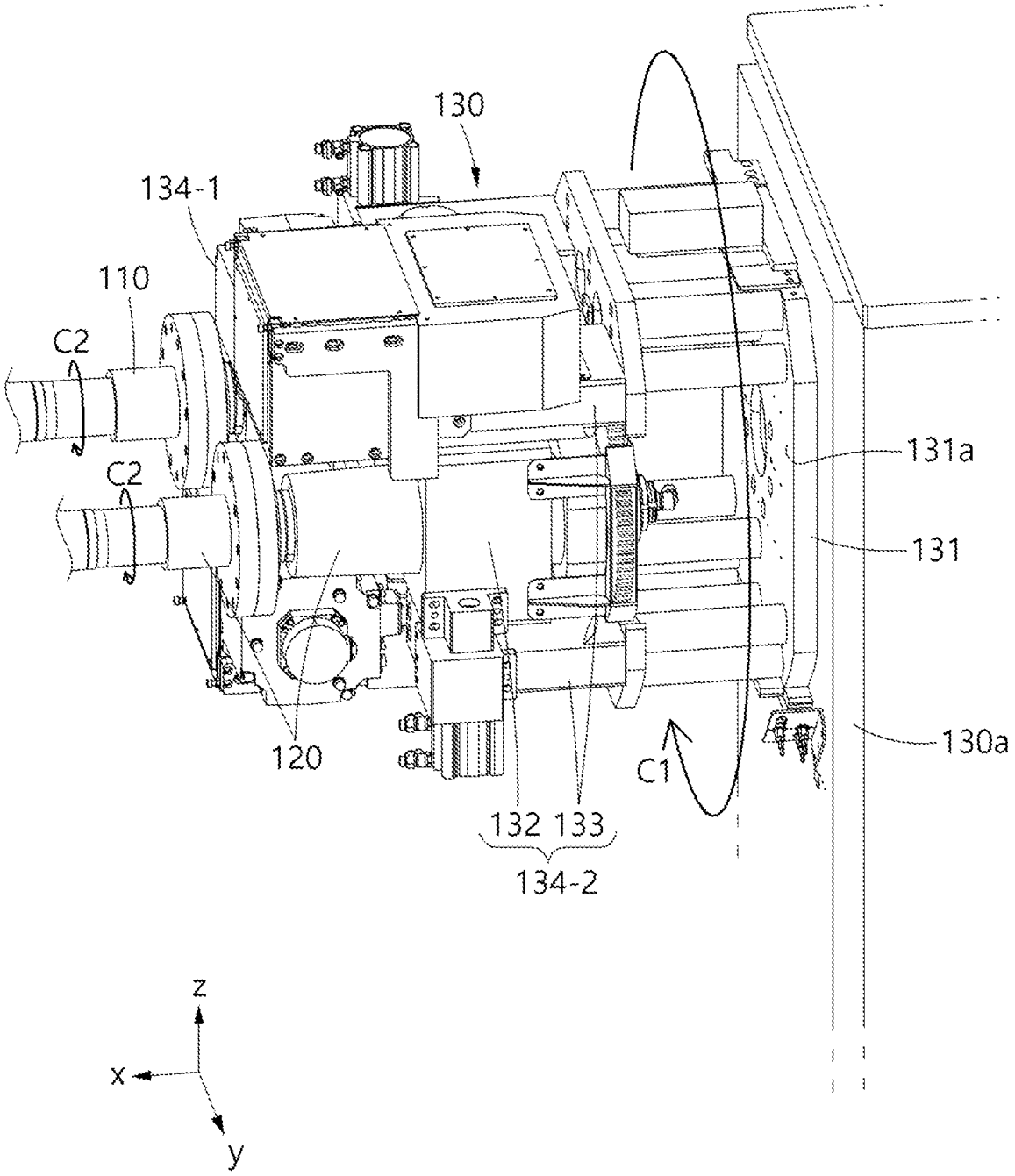
FIG. 3 is an enlarged view illustrating a region A of FIG. 2.

Referring to FIGS. 2 and 3, the rewinding apparatus 100 may include a first mounting member 110 a second mounting member 120 into which a plurality of re-winding rolls R1 and R2 are inserted, and a connecting member 130 connected to an end 110*a* of the first mounting member 110 and an end 120*a* of the second mounting member 120 to move the first mounting member 110 and the second mounting member 120.

The rewinding apparatus 100 may include a plurality of mounting members 110 and 120 on which a plurality of re-winding rolls R1 and R2 on which the thin-film tape T may be wound at the same time are mounted.

For example, in the first mounting member 110, a plurality of first re-winding rolls R1 are mounted at a predetermined interval, and a plurality of thin-film tapes T may be simultaneously wound on the mounted plurality of first re-winding rolls R1.

Accordingly, since the plurality of thin-film tapes T may be rewound through the plurality of first re-winding rolls R1 mounted on the first mounting member 110, instead of one re-winding roll, the rewinding process speed can be increased.

Similarly, in the second mounting member 120, the plurality of second re-winding rolls R2 may be mounted at a preset interval.

Here, the first mounting member 110 and the second mounting member 120 may have the same shape, but the first mounting member 120 and the second mounting member 120 may be disposed at different positions.

For example, the first mounting member 110 and the second mounting member 120 may be disposed parallel to each other.

In addition, the first mounting member 110 and the second mounting member 120 may independently move and rotate by means of the connecting member 130.

For example, the first mounting member 110 may rotate about a shaft X1 of the first mounting member 110, and the second mounting member 120 may independently rotate about a shaft X2 of the second mounting member 120.

Specifically, while the plurality of thin-film tapes T are wound on the plurality of first re-winding rolls R1 mounted on the first mounting member 110 by rotating the first mounting member 110, the second mounting member 120 may be in a non-rotating state.

Accordingly, a user can selectively rewind the plurality of thin-film tapes T by selectively rotating the first mounting member 110 and the second mounting member 120.

The connecting member 130 may be connected to the first mounting member 110 and the second mounting member 120 to independently rotate the first mounting member 110 and the second mounting member 120, and may independently move the first mounting member 110 and the second mounting member 120.

In addition, the connecting member 130 may rotate the first mounting member 110 and the second mounting member 120 to change the positions of the first mounting member 110 and the second mounting member 120, and may move at least one of the first mounting member 110 and the second mounting member 120 to the place where the loading apparatus 200 is arranged.

Specifically, the connecting member 130 may include a rotation plate 131, and a first interlocking member 134-1 and a second interlocking member 134-2 connected to one surface 131*a* of the rotation plate 131 to independently rotate and move the first mounting member 110 and the second mounting member 120, respectively.

That is, one mounting member may be connected to one interlocking member. For example, an end 110*a* of the first mounting member 110 is connected to the first interlocking member 134-1, and an end 120*a* of the second mounting member 120 is connected to the second interlocking member 134-2.

Accordingly, as the rotation plate 131 that is connected to the first interlocking member 134-1 and the second interlocking member 134-2 rotates in a preset direction C1 on a side surface 130*a* of the connecting member, the positions of the first mounting member 110 and the second mounting member 120 may be interchanged.

Here, the rotation plate 131 may be located on the side surface 130*a* of the connecting member, and may be parallel to the YZ plane.

The first interlocking member 134-1 and the second interlocking member 134-2 have the same structure, and thus, for convenience of description, the following description will focus on one interlocking member.

The second interlocking member 134-2 may include a rotation member 132 that rotates the second mounting member 120 about the shaft X2 of the second mounting member 120, and shaft moving members 133 disposed at both ends of the rotation member 132 so as to be perpendicular to the shaft X2 to move and rotate the rotation member 132 in the horizontal direction (XY plane).

Therefore, the second mounting member 120 can rotate about the shaft X2 of the second mounting member 120 through the rotating member 132, and can be moved on the XY plane through the shaft moving members 133.

Hereinafter, with reference to FIGS. 4 to 6, the cutting apparatus 300 according to an embodiment of the present disclosure will be described in detail.

Figure 4:
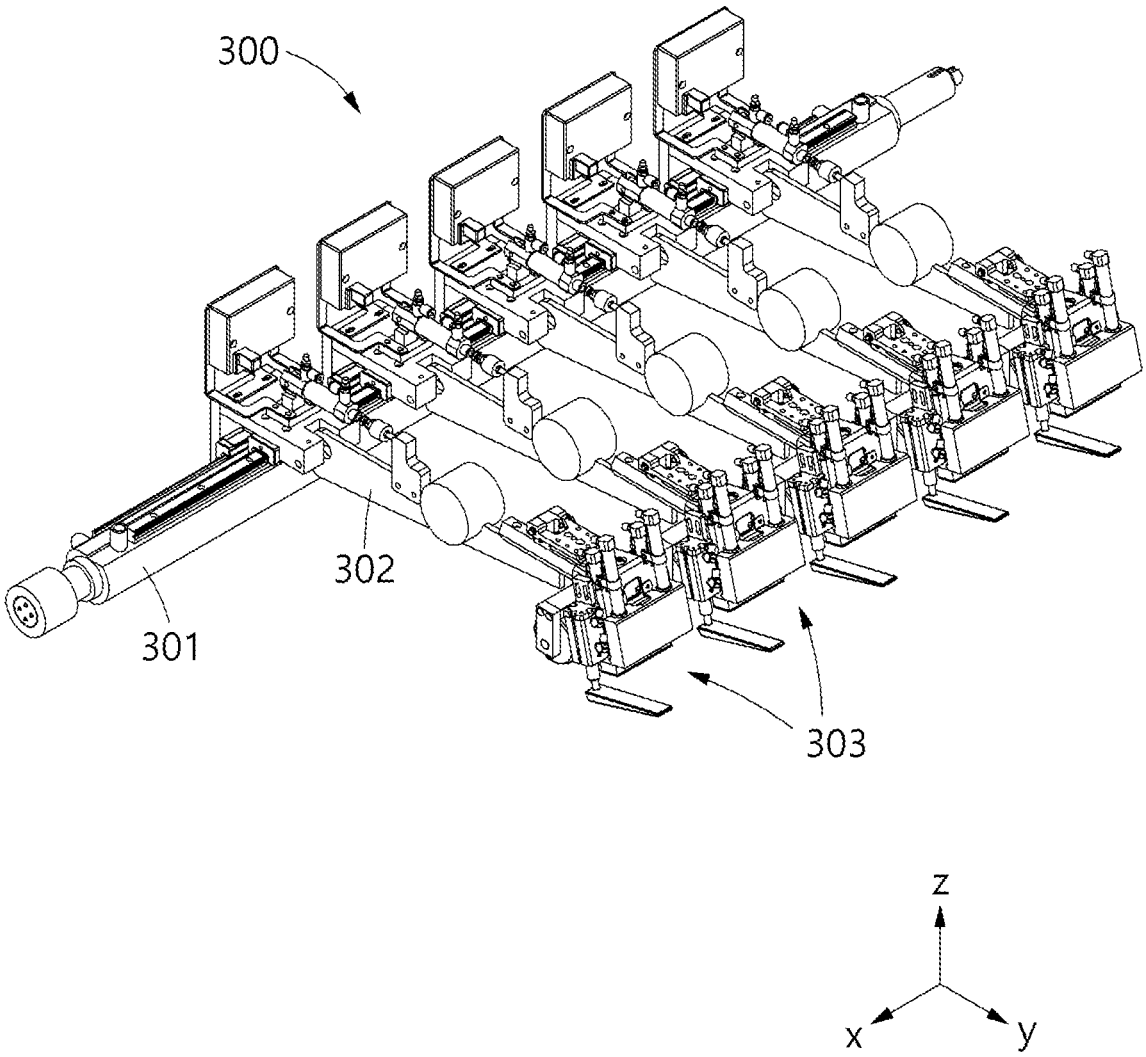
FIG. 4 is a perspective view showing a cutting apparatus according to an embodiment of the present disclosure.
Figure 5:
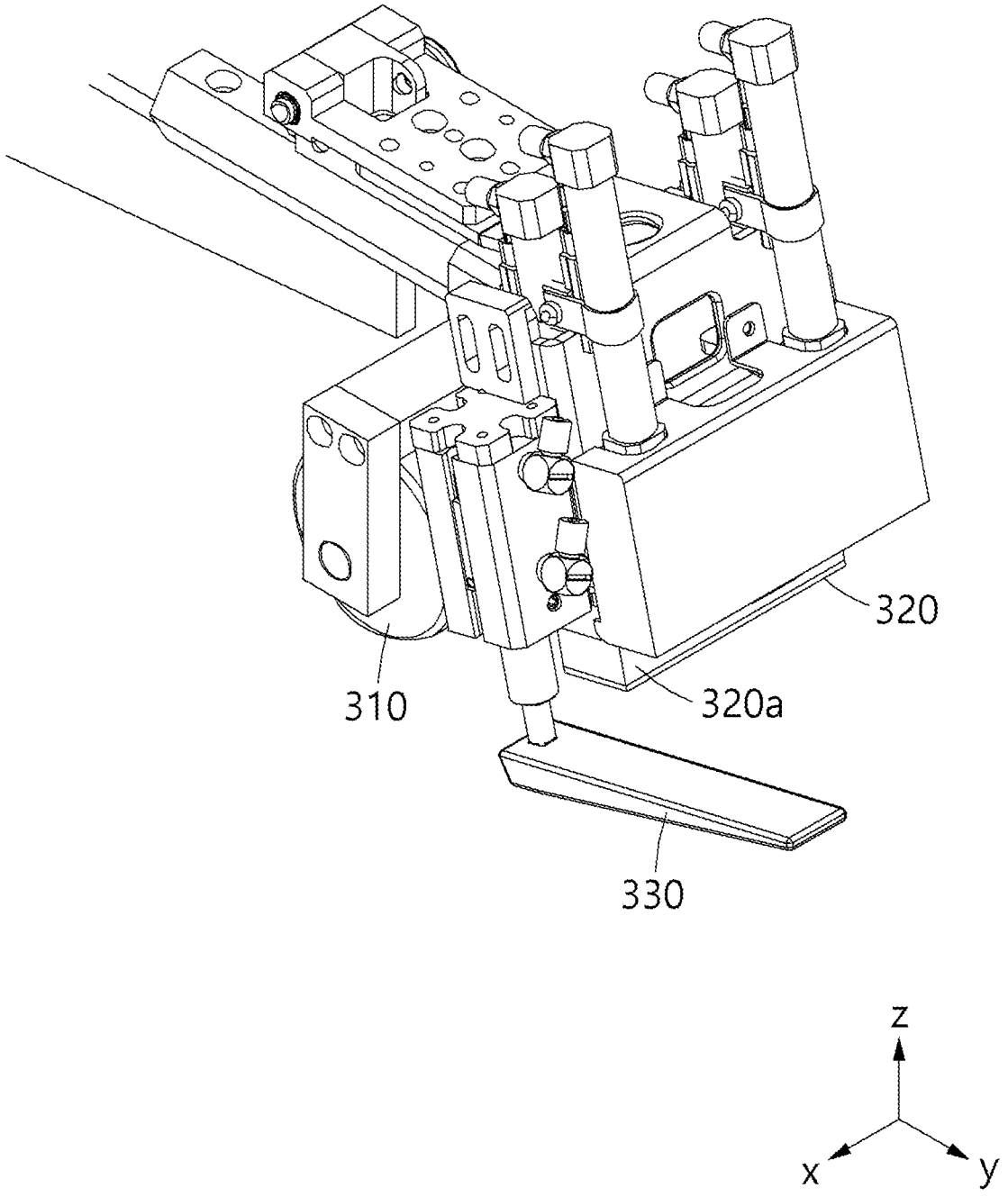
FIG. 5 is a top enlarged view showing the cutting apparatus according to an embodiment of the present disclosure.

FIG. 4 is a perspective view showing a cutting apparatus 300 according to an embodiment of the present disclosure. FIG. 5 is a top enlarged view showing the cutting apparatus 300 according to an embodiment of the present disclosure. FIG. 6 is a bottom enlarged view showing the cutting apparatus 300 according to an embodiment of the present disclosure.

Referring to FIG. 1, the cutting apparatus 300 is disposed on the first mounting member 110 or the second mounting member 120 to be rewound, and can cut the rewound thin-film tape T.

Referring to FIG. 4, the cutting apparatus 300 may have a plurality of multi joint members 302 arranged at a preset interval on one reference shaft 301, and a plurality of cutting members 303 may be arranged at one end of each of the multi joint members 302.

Here, the number of the cutting members 303 may correspond to the number of the plurality of re-winding rolls R1 and R2. Accordingly, one cutting member 303 may cut the thin-film tape T of one of the re-winding rolls R1 and R2.

In addition, cutting apparatus 300 may rotate about the reference shaft 301, and accordingly, a roller part 310 may be selectively brought into contact with the thin-film tape T wound on the plurality of re-winding rolls R1 and R2.

The cutting apparatus 300 may include: a roller part 310 for rolling the outer circumferential surface of the thin-film tape T wound on the re-winding rolls R1 and R2; an adsorption part 320 for vacuum-adsorbing the thin-film tape T rolled by the roller part 310; a fixing part 330 for selectively fixing the thin-film tape T adsorbed to the adsorption part 320; and a blade that slidably moves so as to be adjacent to one surface 320*a* of the adsorption part 320 in order to cut the thin-film tape T.

The roller part 310, corresponding to a rear of the cutting member 303, is located behind the adsorption part 320 and the blade 340, and may be composed of a rotatable roll.

Here, the rear of the cutting member 303 means a place adjacent to the reference shaft 301 of the cutting apparatus 300.

The roller part 310 is in contact with one re-winding roll R1 to continuously press the thin-film tape T wound on the re-winding roll R1, and may prevent a space in the thin-film tape T wound on the re-winding roll R1 from occurring.

Figure 8:
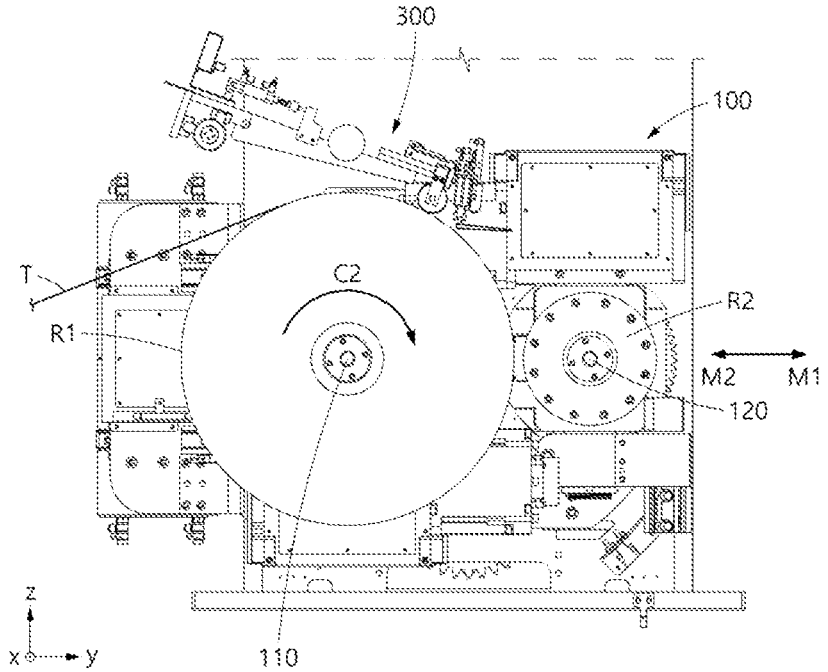
FIG. 8 is a side view illustrating the rewinding apparatus according to an embodiment of the present disclosure.

For example, as shown in FIG. 8, when the thin-film tape T is wound on the first re-winding roll R1 mounted on the first mounting member 110 by rotating the first mounting member 110 in a preset direction C2, the roller part 310 may continuously contact the thin-film tape T wound on the first re-winding roll R1 and thus may press the thin-film tape T in the direction of the rotation center of the first mounting member 110.

Similarly, even when the positions of the first mounting member 110 and the second mounting member 120 are changed, the second mounting member 120 is rotated in the preset direction C2, and the thin-film tape T is wound on the second re-winding roll R2 mounted on the second mounting member 120, the roller part 310 continuously contacts the thin-film tape T wound on the second re-winding roll R2 to press the thin-film tape T in the direction of the rotation center of the second mounting member 120.

Accordingly, the roller part 310 may allow thin-film tapes T wound on the re-winding roll R1 to be in close contact with each other, and may prevent lifting from occurring between the thin-film tapes T wound on the re-winding roll R1, thereby reducing manufacturing tolerances.

The adsorption part 320 may include a contact portion 321 in contact with the thin-film tape T, and an adsorption space 322 stepped with respect to the contact portion 321 to adsorb and fix one surface of the thin-film tape T.

Here, the adsorption part 320 does not continuously contact the thin-film tape T, but selectively adsorbs the thin-film tape T when the thin-film tape T needs to be cut to adsorb the thin-film tape T to then fix the same to the adsorption part 320.

The contact portion 321 may come into contact with one surface of the thin-film tape T, and the adsorption space 322 may form a pressurized space in which the air may be adsorbed through a suction port 323 formed in the adsorption space 322 to adsorb the thin-film tape T.

The width of the contact portion 321 may be equal to or greater than the width of the thin-film tape T, and the width of the adsorption space 322 may be equal to or smaller than the width of the thin-film tape T. Accordingly, the entire thin-film tape T can be prevented from being rolled into the adsorption space 322.

The contact portion 321 may be disposed on the outer peripheral surface of the adsorption space 322, and the adsorption space 322 may be formed to be stepped to form a space with respect to the contact portion 321.

The suction port 323 may be disposed at a position facing one surface of the thin-film tape T, and the number thereof may vary in consideration of the pressure at which the thin-film tape T can be properly adsorbed.

The adsorption part 320 may be disposed in front of the roller part 310. Here, the front may mean a place far from the reference shaft 301.

The fixing part 330 may axially rotate with respect to the adsorption part 320, and may selectively cover one surface of the adsorption space 322 and the contact portion 321.

Figure 6:
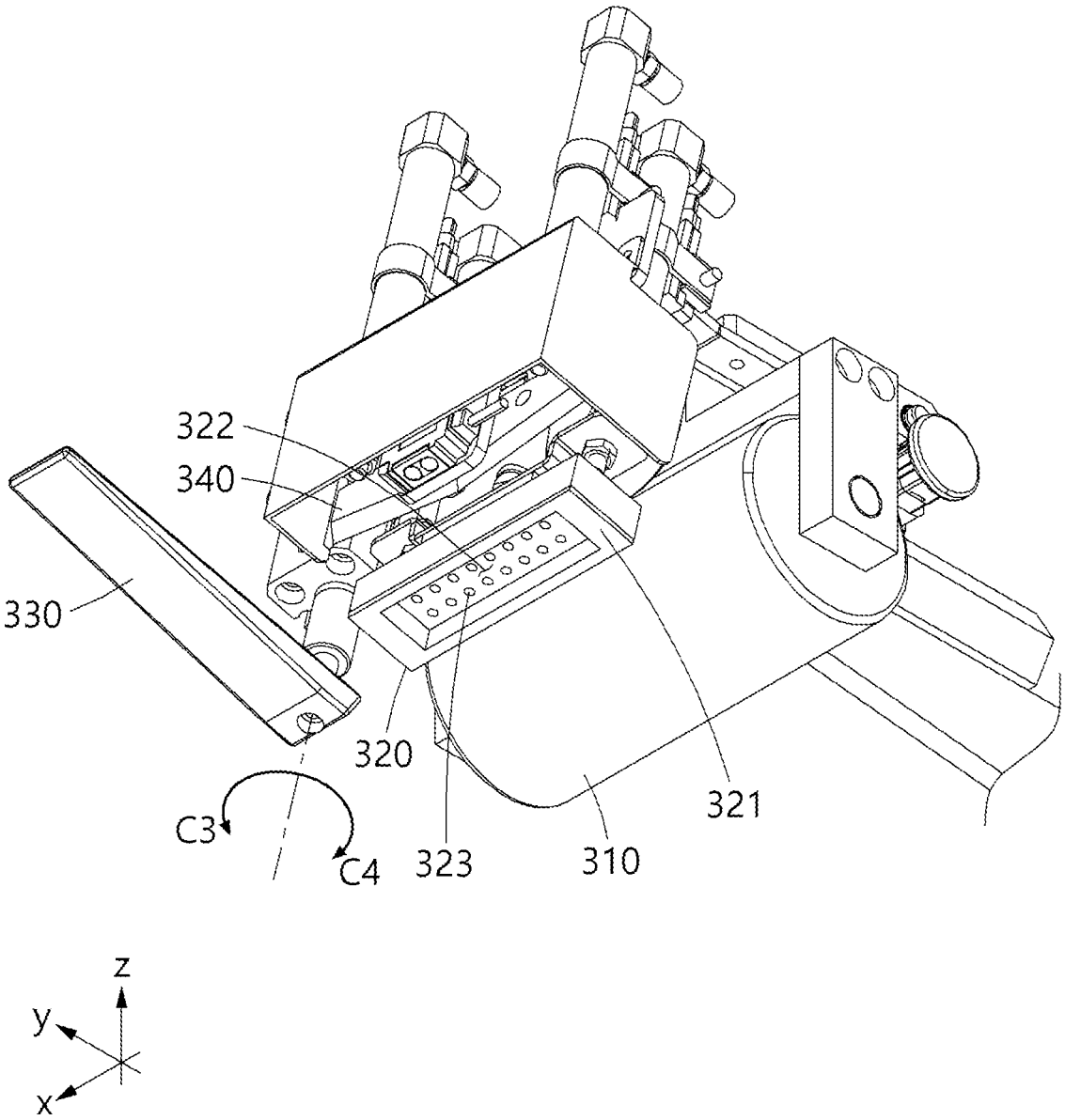
FIG. 6 is a bottom enlarged view showing the cutting apparatus according to an embodiment of the present disclosure.
Figure 10:
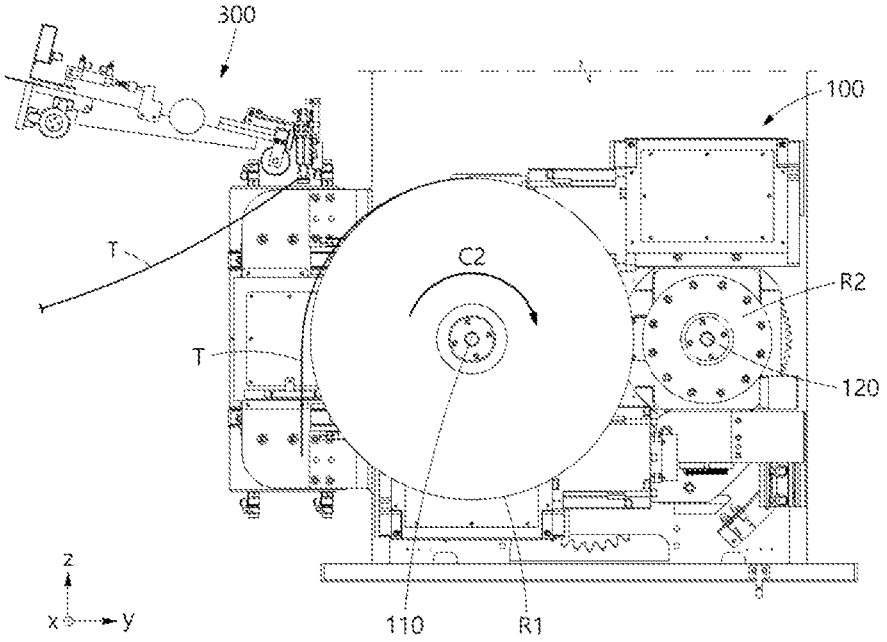
FIG. 10 is a side view illustrating a state in which a thin-film tape is cut in the state shown in FIG. 9.

For example, the fixing part 330 may move between a spaced-apart state from the adsorption part 320, as shown in FIG. 6, and a fixed state in which the upper surface thereof is in contact with the lower surface of the thin-film tape T being in contact with the contact portion 321, as shown in FIG. 10, thereby selectively completely fixing the thin-film tape T.

Specifically, as shown in FIG. 6, in a state in which the fixing part 330 and the adsorption part 320 are spaced apart from each other, the adsorption part 320 may adsorb the thin-film tape T. Here, the upper surface of the thin-film tape T is in contact with the adsorption part 320. Next, in a state in which the fixing part 330 axially moves in the direction C4 in which the absorption part 320 is located, the fixing part 330 closely moves with respect to the absorption part 320, so that the fixing part 330 is brought into contact with the lower surface of the thin-film tape T.

Accordingly, the upper surface of the thin-film tape T is in contact with the adsorption part 320, and the lower surface of the thin-film tape T is in contact with the fixing part 330, thereby cutting the thin-film tape T by means of the blade 340 after being completely fixed to the cutting apparatus 300.

After the thin-film tape T is cut, the fixing part 330 may axially move in the direction C3 spaced apart from the adsorption part 320 again to be spaced apart from the adsorption part 320.

The blade 340 slidably moves on the thin-film tape T fixed by the fixing part 330 and the adsorption part 320 to cut the thin-film tape T. The blade may have various shapes, but at least may have a width greater than the width of the thin-film tape T.

Hereinafter, a loading guide apparatus 400 according to an embodiment of the present disclosure will be described with reference to FIG. 7.

Figure 7:
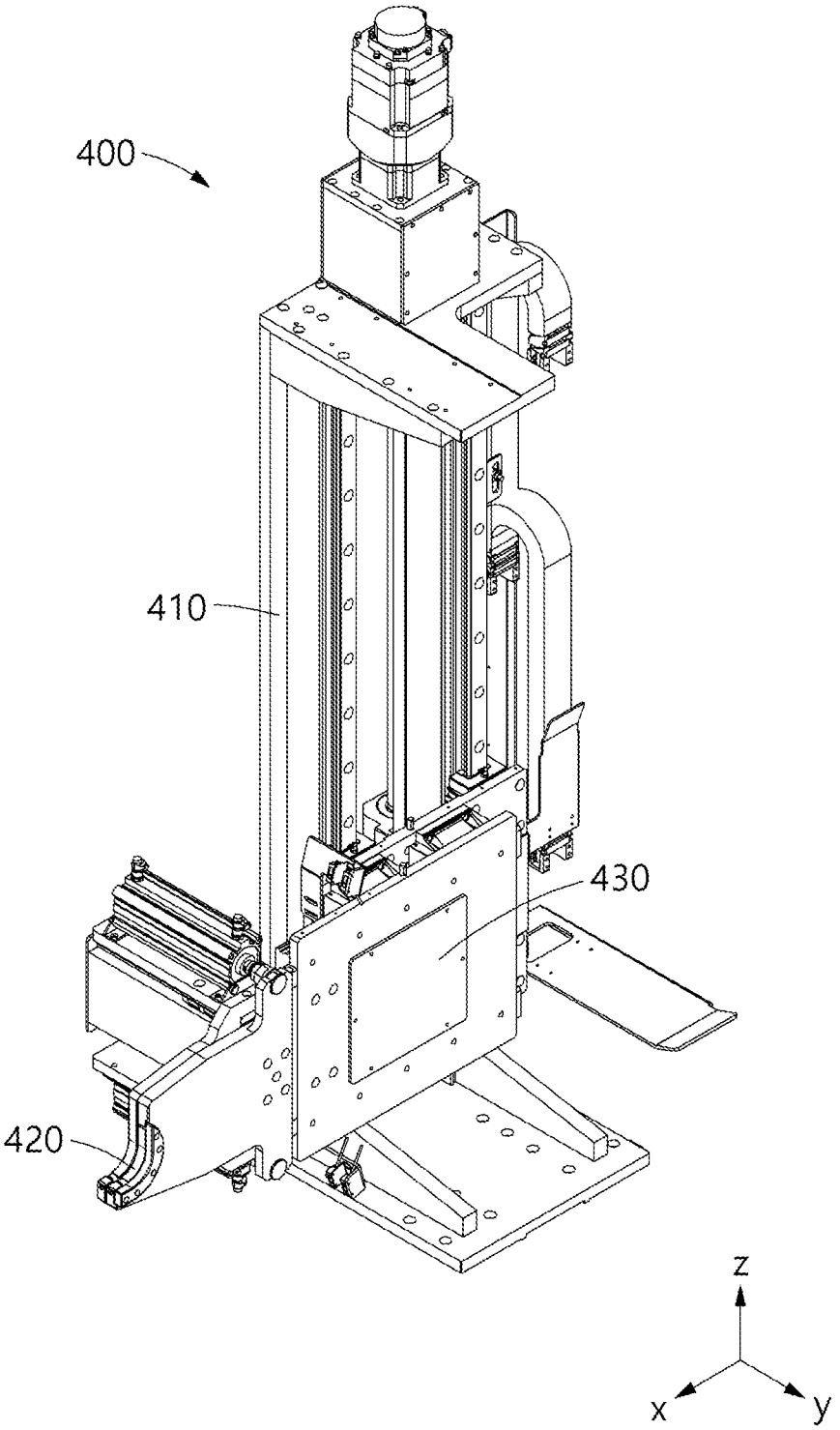
FIG. 7 is a perspective view showing a loading guide apparatus according to an embodiment of the present disclosure.

FIG. 7 is a perspective view showing a loading guide apparatus 400 according to an embodiment of the present disclosure.

Referring to FIGS. 1 and 7, the loading guide apparatus 400 may be disposed between the rewinding apparatus 100 and the loading apparatus 200, and may be arranged to connect at least one of the first mounting member 110 having moved adjacent to the loading apparatus 200 and the second mounting member 120.

In addition, the loading guide apparatus 400 may include: a support part 420 for supporting the other end 110*b* or 120*b* (see FIG. 12) of at least one of the first mounting member 110 and the second mounting member 120 having moved adjacent to the loading apparatus 200 to horizontally maintain the other end of at least one of the first mounting member and the second mounting member; and a guide moving part 410 for adjusting the horizontality of the other end 110*b* or 120*b* of at least one of the first mounting member 110 and the second mounting member 120 having moved adjacent to the loading apparatus 200 by vertically and horizontally moving the support part 420.

In addition, the loading guide apparatus 400 is connected to a rail part 20 (see FIG. 1) together with the rewinding apparatus 100 to move relative to each other.

The guide moving part 410 may move in the horizontal direction along the rail part 20 and may move the support part 420 in the vertical direction.

Accordingly, the guide moving part 410 moves so as to allow the support part 420 to support the mounting member of the first and second mounting members 110 and 120, which has moved adjacent to the loading apparatus 200 in the horizontal direction.

In addition, when a plurality of rewinding apparatuses 100 are disposed, the guide moving part 410 may move the support part 420 up and down to horizontally align the mounting members connected to the two rewinding apparatuses 100.

The support part 420 may be moved in the vertical direction by the guide moving part 410, and may support the other end of the mounting member inclined by the weight of the plurality of re-winding rolls R1 and R2.

The guide plate 430 may be disposed on one surface of the support part 420, and may push the plurality of re-winding rolls R1 and R2 to the loading apparatus 200. The guide plate 430 may extend with respect to the support part 420, and thus the plurality of re-winding rolls R1 and R2 are brought into contact with the side surfaces of the plurality of re-winding rolls R1 and R2, thereby moving the plurality of re-winding rolls R1 and R2 along the mounting member.

Hereinafter, the operation of the rewinding apparatus 100 according to an embodiment of the present disclosure will be described with reference to FIGS. 8 to 11.

Figure 9:
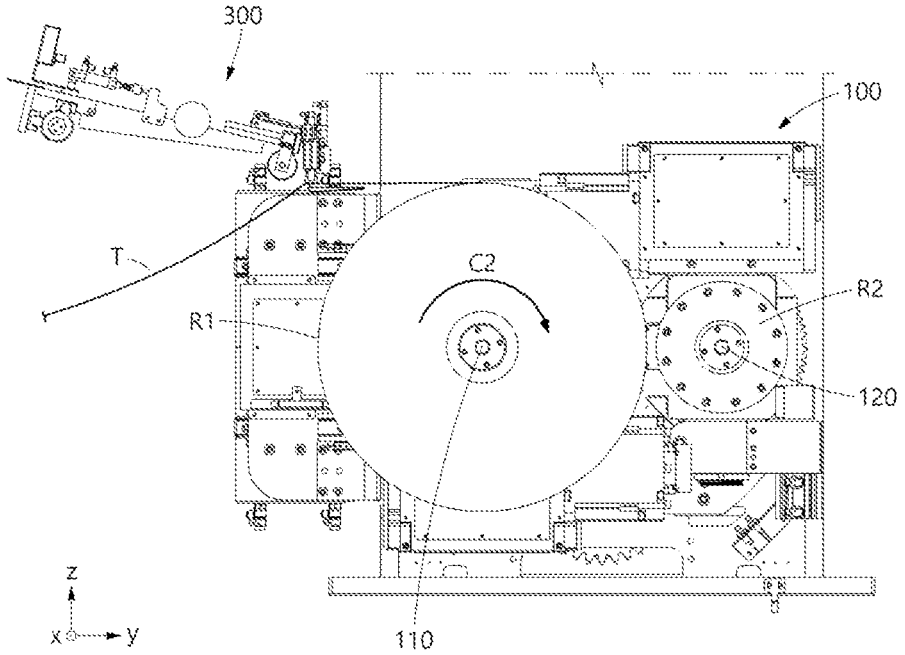
FIG. 9 is a side view showing the operation of the cutting apparatus in the state of FIG. 8.
Figure 11:
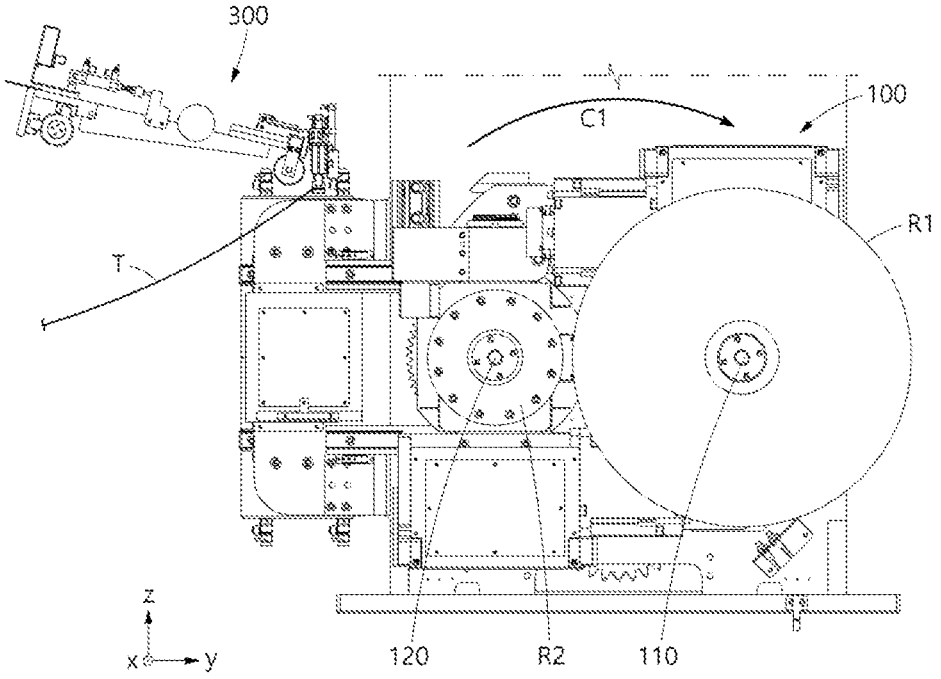
FIG. 11 is a side view illustrating that the positions of the first and second mounting members are changed in the state shown in FIG. 10.

FIG. 8 is a side view illustrating the rewinding apparatus 100 according to an embodiment of the present disclosure, FIG. 9 is a side view showing the operation of the cutting apparatus 300 in the state of FIG. 8, FIG. 10 is a side view illustrating a state in which a thin-film tape T is cut in the state shown in FIG. 9, and FIG. 11 is a side view illustrating that the positions of the first and second mounting members 110 and 120 are changed in the state shown in FIG. 10.

First, as shown in FIG. 8, the first mounting member 110 may be axially rotated in a preset direction C2 to wind the manufactured thin-film tape T on the first re-winding roll R1.

Specifically, the rotation member 132 connected to the first mounting member 110 may rotate the first mounting member 110 about the rotation shaft of the first mounting member 110.

Here, the outer peripheral surface of the first re-winding roll R1 may be in continuous contact with the roller part 310 of the cutting apparatus 300.

Thereafter, after it is detected by means of a sensor (not shown) that the thin-film tape T is wound on the first re-winding roll R1 so as to have a predetermined outer diameter, the rewinding apparatus 100 moves in a direction M1 adjacent to the loading apparatus 200.

Here, while the rewinding apparatus 100 moves in the M1 direction, the adsorption part 320 of the cutting apparatus 300 may adsorb the thin-film tape T. Accordingly, as shown in FIG. 9, a portion of the thin-film tape T may be in contact with the adsorption part 320 of the cutting apparatus 300.

That is, by partially moving the rewinding apparatus 100 in the M1 direction, a region where the thin-film tape T is cut can be secured, thereby automatically and continuously performing the process of rewinding the thin-film tape T.

Next, as shown in FIG. 10, in a state in which the fixing part 330 comes into contact with the adsorption part 320 to completely fix the thin-film tape T, the thin-film tape Tis cut by the blade 340.

Here, a portion of the cut thin-film tape T is in a state of being flowed down by its own weight, and the rewinding apparatus 100 further rotates a part of the first mounting member 110, thereby automatically winding the thin-film tape T having flowed down by its own weight on the first re-winding roll R1.

Next, as shown in FIG. 11, the rewinding apparatus 100 rotates the rotation plate 131 in the C1 direction, thereby changing the positions of the first mounting member 110 and the second mounting member 120.

That is, after the thin-film tape T is completely wound on the first mounting member 110, the position of the first mounting member 110 and the position of the second mounting member 120 are changed, thereby rewinding the thin-film tape T on the second mounting member 120.

Accordingly, by sequentially performing the rewinding operations of the first mounting member 110 and the second mounting member 120 in that order, the rewinding process speed and efficiency of the rewinding system 1 may be greatly improved.

Here, FIG. 11 shows that the positions of the first mounting member 110 and the second mounting member 120 are changed after the thin-film tape T is rewound on the plurality of re-winding rolls R1 inserted into the first mounting member 110, which may mean a third state.

In addition, the rewinding apparatus 100 rotates the first mounting member 110 and the second mounting member 110 in the same direction C1 as the direction C2 in which the first mounting member 110 rotates about the shaft of the first mounting member 110, thereby changing the positions of the first mounting member 110 and the second mounting member 120.

Accordingly, the process lines and the dynamic profiles do not overlap between the rewinding operations of the first mounting member 110 and the second mounting member 120 and the operations of changing the positions of the first mounting member 110 and the second mounting member 120 through rotation in the same direction, thereby improving the efficiency of the manufacturing process.

Hereinafter, a process in which the plurality of second re-winding rolls R2 on which the thin-film tape T is rewound is loaded in the loading apparatus 200 will be described with reference to FIGS. 12 to 15.

Figure 12:
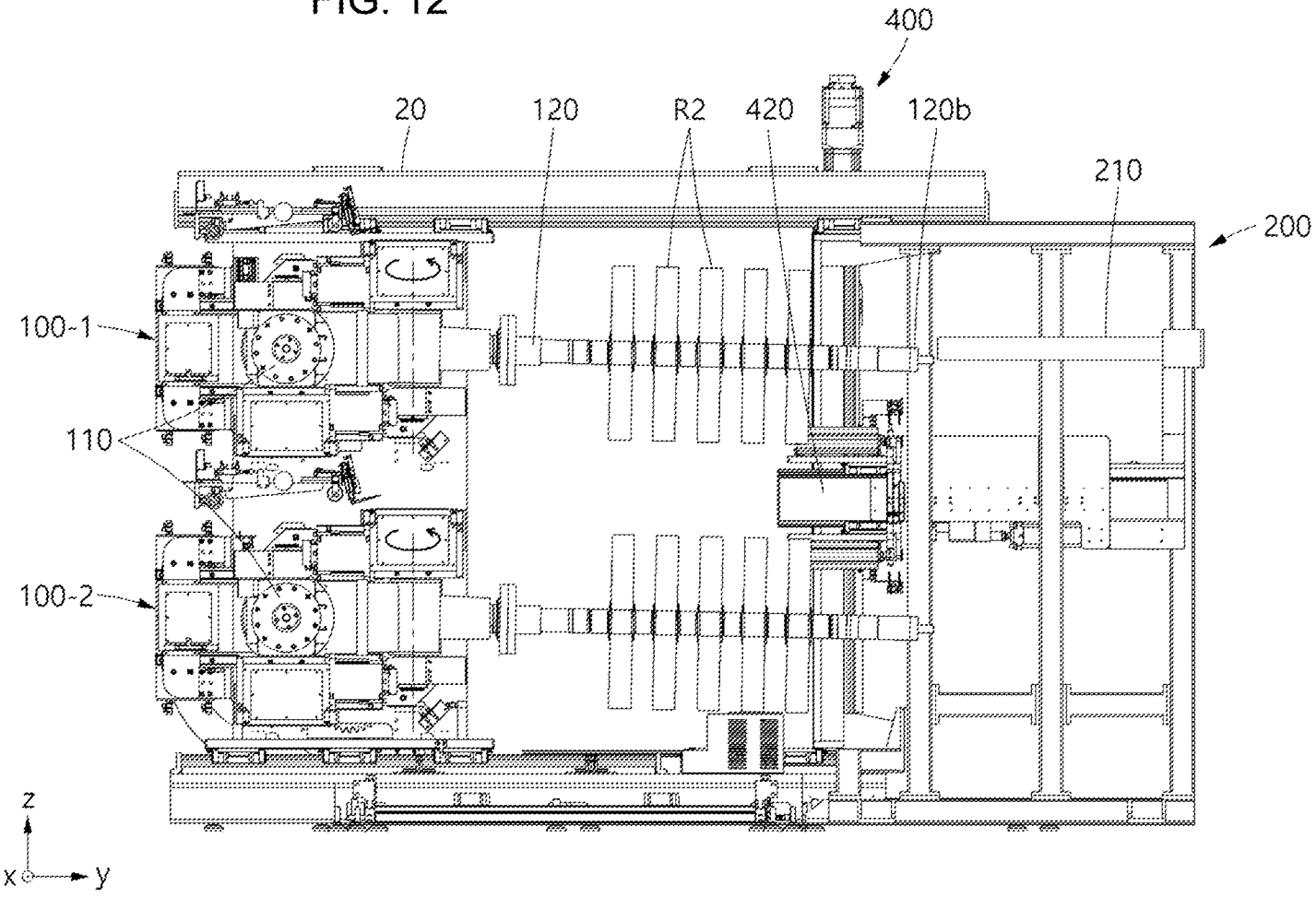
FIG. 12 is a side view illustrating a first state in the rewinding system according to an embodiment of the present disclosure.
Figure 13:
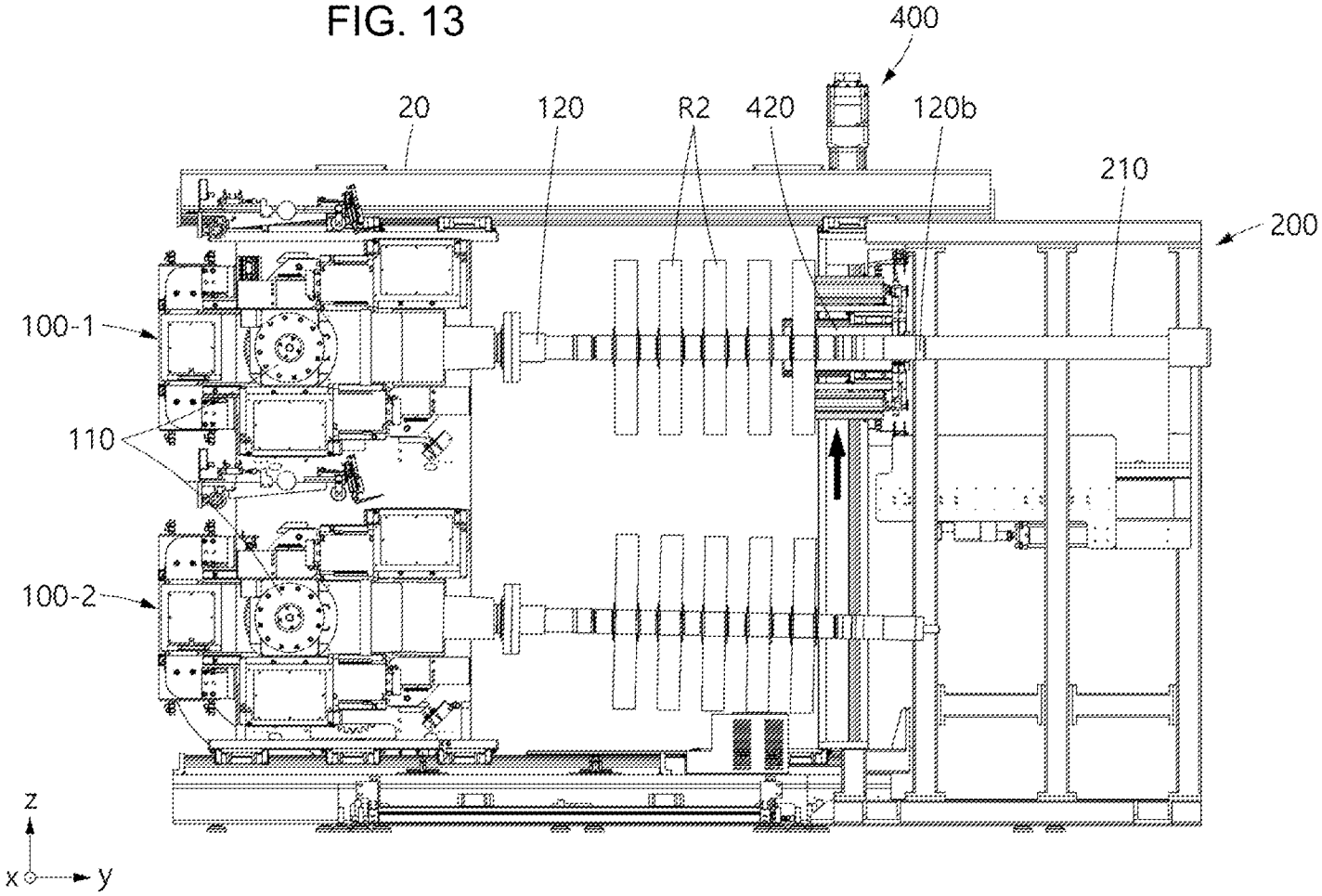
FIG. 13 is a side view showing the movement of the loading guide apparatus in the state shown in FIG. 12.
Figure 14:
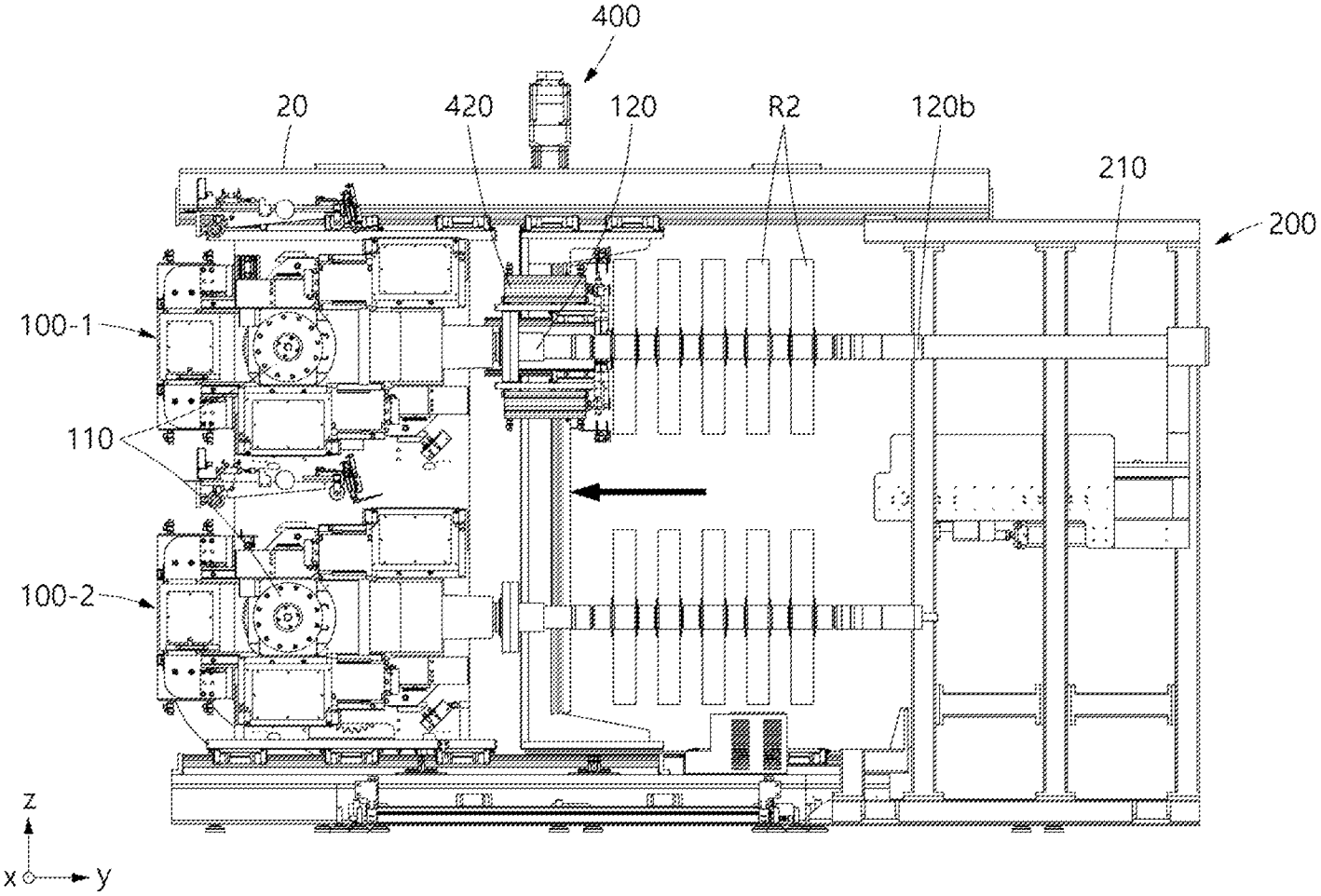
FIGS. 14 and 15 are side views illustrating that the loading guide apparatus guides a plurality of re-winding rolls to the loading apparatus in the state shown in FIG. 13.
Figure 15:
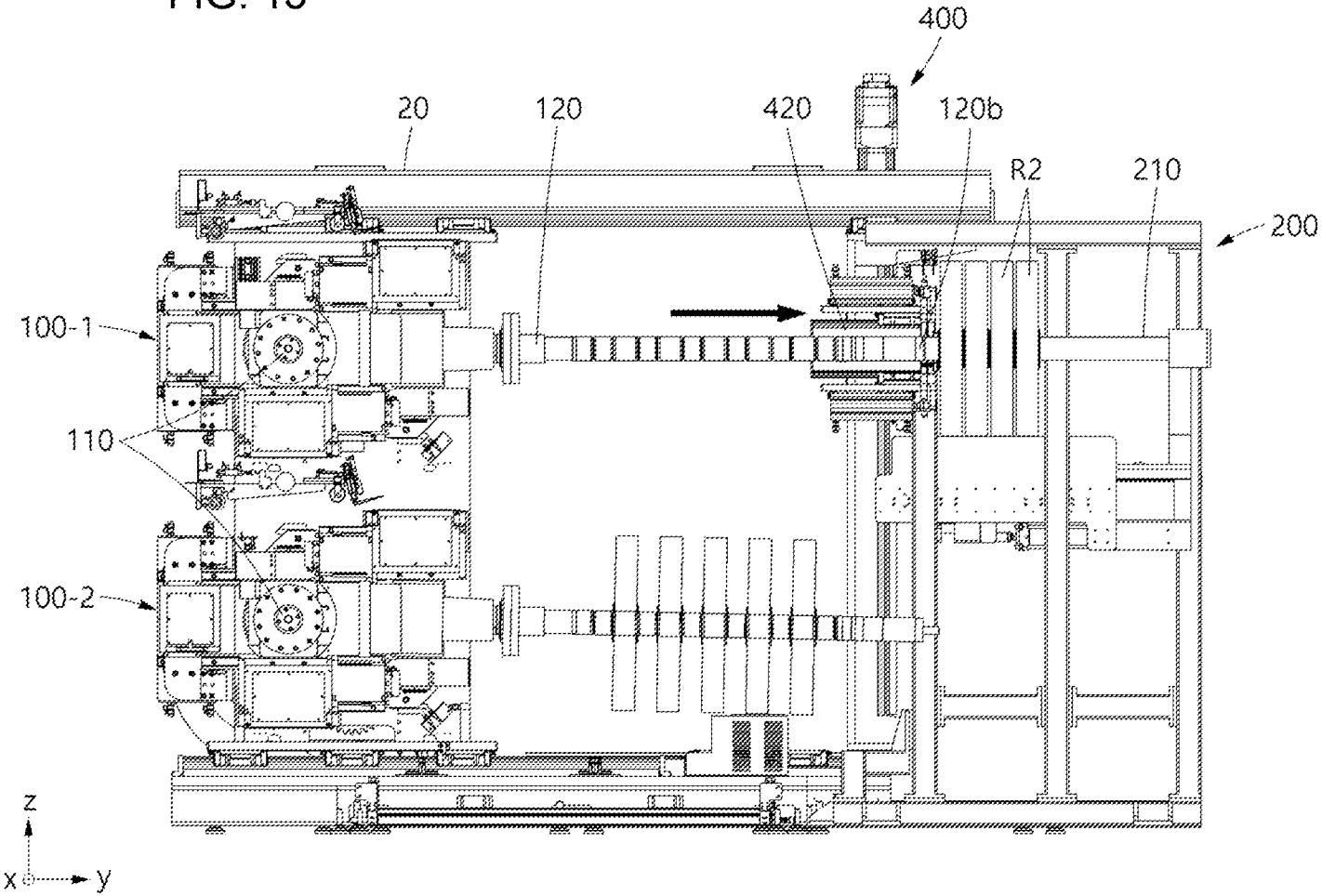

FIG. 12 is a side view illustrating a first state in the rewinding system 1 according to an embodiment of the present disclosure, FIG. 13 is a side view showing the movement of the loading guide apparatus 400 in the state shown in FIG. 12, and FIGS. 14 and 15 are side views illustrating that the loading guide apparatus 400 guides a plurality of re-winding rolls R2 to the loading apparatus in the state shown in FIG. 13.

Referring to FIG. 12, while the thin-film tape T is rewound on the plurality of first re-winding rolls R1 inserted into the first mounting member 110, the rewinding system 1 may move the second mounting member 120 into which the plurality of rewinding second re-winding rolls R2 are inserted to a place where the loading apparatus 200 is located.

Here, the second mounting member 120 may move to a place adjacent to the loading apparatus 200 along the XY plane by the shaft moving member 133 shown in FIG. 3.

That is, while the first mounting member 110 rewinds the thin-film tape T, the second mounting member 120 on which the rewinding is completed may move to load the plurality of second re-winding rolls R2.

Here, in the second mounting member 120 having moved adjacent to the loading apparatus 200, the other end 120*b* thereof is partially lowered by the weight of the plurality of second re-winding rolls R2, so that the second mounting member 120 and the loading member 210 of the loading apparatus 200 are in a state in which they are not aligned with each other.

Here, the loading member 210 may be provided in the loading apparatus 200, and at least one other end 110*b*, 120*b* of the first mounting member 110 and the second mounting member 120 may be inserted thereinto.

As shown in FIG. 13, after moving to a place adjacent to the other end 120*b* of the second mounting member 120, the support part 420 may be moved to align the other end 120*b* of the second mounting member 120 with the loading member 210.

Next, as shown in FIGS. 14 and 15, in a state in which at least one other end 110*b*, 120*b* of the first mounting member 110 and the second mounting member 120 is inserted into and connected to the loading member 210, the thin-film tape T is rewound in the connected state, the support part 420 may guide the plurality of re-winding rolls R1 and R2) to be pushed in the direction in which the loading member 210 is located.

Accordingly, the plurality of re-winding rolls R1 and R2 on which the thin-film tape T is rewound may be loaded side by side on the loading member 210.

Next, after the plurality of re-winding rolls R2 on which the thin-film tape T inserted into the second mounting member 120 is rewound are loaded in the loading apparatus 200, the rewinding system 1 may move the second mounting member 120 back to a place adjacent to the first mounting member 110.

That is, the rewinding system 1 may repeatedly operate: a first state in which, while the thin-film tape T is being rewound on the plurality of re-winding rolls R1 inserted into the first mounting member 110, the second mounting member 120 into which the plurality of re-winding rolls R2 on which the thin-film tape T is rewound is moved to a place where the loading apparatus 200 is located; a second state in which, after the plurality of re-winding rolls R2 on which the thin-film tape T inserted into the second mounting member 120 is rewound is loaded in the loading apparatus 200, the second mounting member 120 is moved back to a place adjacent to the first mounting member 110; a third state in which, after the thin-film tape T is rewound on the plurality of re-winding rolls R1 inserted into the first mounting member 110, the positions of the first mounting member 110 and the second mounting member 120 are changed; a fourth state in which, while the thin-film tape T is being rewound on the plurality of re-winding rolls R2 inserted into the second mounting member 120, the first mounting member 110 into which the plurality of re-winding rolls R1 on which the thin-film tape T is rewound are inserted is moved to a place where the loading apparatus 200 is located; and a fifth state in which, after the plurality of re-winding rolls R1 on which the thin-film tape T inserted into the first mounting member 110 is rewound are loaded in the loading apparatus 200, the first mounting member 110 is moved back to a place adjacent to the second mounting member 120.

That is, in the aforementioned rewinding system 1, while the first mounting member 110 performs rewinding, the second mounting member 120 on which the rewinding is completed may perform a loading operation, and while the second mounting member 120 performs rewinding, the first mounting member 110 on which the rewinding is completed may perform a loading operation.

Accordingly, the rewinding system 1 rotates the first mounting member and the second mounting member 120 on its own, and automatically and continuously rewinds and loads the thin-film tape T through the configurations and operations for changing the positions of the first mounting member and the second mounting member 120, thereby greatly improving the efficiency of the rewinding process of the thin-film tape T.

While various embodiments of the present disclosure have been individually described, each embodiment is not necessarily implemented alone, and the configurations and operations of each embodiment may be implemented in combination with at least one of other embodiments.

In addition, although preferred embodiments of the present disclosure have been illustrated and described above, the present disclosure is not limited to the specific embodiments described above, and the technical field to which the disclosure belongs without departing from the gist of the present disclosure as claimed in the claims, and these modifications should not be individually understood from the spirit or prospect of the present disclosure.

The invention claimed is:

1. A rewinding system, comprising:

a rewinding apparatus for winding a manufactured thin-film tape on a re-winding roll;

a loading apparatus for loading the re-winding roll on which the thin-film tape is rewound; and a cutting apparatus for cutting the thin-film tape, wherein:

the rewinding apparatus includes a first mounting member and a second mounting member in which a plurality of re-winding rolls are inserted, and a connecting member connected to an end of the first mounting member and an end of the second mounting member to move the first mounting member and the second mounting member;

the first mounting member rotates around a shaft thereof and the second mounting member rotates around a shaft thereof;

the connecting member rotates the first mounting member and the second mounting member to change positions of the first mounting member and the second mounting member, and moves at least one of the first mounting member and the second mounting member to a place where the loading apparatus is arranged; and the cutting apparatus includes a roller part for rolling an outer circumferential surface of the thin-film tape wound on the re-winding roll, an adsorption part for vacuum-adsorbing the thin-film tape rolled by the roller part, a fixing part for selectively fixing the thin-film tape adsorbed to the adsorption part, and a blade that slidably moves so as to be adjacent to one surface of the adsorption part in order to cut the thin-film tape.

2. The rewinding system of claim 1, wherein:

the connecting member includes:

a rotating plate; and a first interlocking member and a second interlocking member connected to the rotating plate and one surface of the rotating plate to independently rotate and move the first and second mounting members, respectively, and the first interlocking member includes:

a rotation member for rotating the first mounting member about the shaft thereof; and shaft moving members at both ends of the rotation member to be perpendicular to the shaft of the first mounting member to move the rotation member in a horizontal direction.

3. The rewinding system of claim 1, wherein the rewinding apparatus repeatedly operates:

a first state in which, while the thin-film tape is being rewound on the plurality of re-winding rolls inserted into the first mounting member, the second mounting member into which the plurality of re-winding rolls on which the thin-film tape is rewound is moved to a place where the loading apparatus is located;

a second state in which, after the plurality of re-winding rolls on which the thin-film tape inserted into the second mounting member is rewound is loaded in the loading apparatus, the second mounting member is moved back to a place adjacent to the first mounting member;

a third state in which, after the thin-film tape is rewound on the plurality of re-winding rolls inserted into the first mounting member, the positions of the first mounting member and the second mounting member are changed;

a fourth state in which, while the thin-film tape is being rewound on the plurality of re-winding rolls inserted into the second mounting member, the first mounting member into which the plurality of re-winding rolls on which the thin-film tape is rewound are inserted is moved to a place where the loading apparatus is located; and a fifth state in which, after the plurality of re-winding rolls on which the thin-film tape inserted into the first mounting member is rewound are loaded in the loading apparatus, the first mounting member is moved back to a place adjacent to the second mounting member.

4. The rewinding system of claim 3, further comprising a loading guide apparatus between the rewinding apparatus and the loading apparatus and arranged to connect the loading apparatus with at least one of the first and second mounting members having moved adjacent to the loading apparatus, wherein the loading guide apparatus includes:

a support part for supporting another end of at least one of the first mounting member and the second mounting member having moved adjacent to the loading apparatus to horizontally maintain the other end of at least one of the first mounting member and the second mounting member; and a guide moving part for adjusting the horizontality of the other end of at least one of the first mounting member and the second mounting member having moved adjacent to the loading apparatus by vertically and horizontally moving the support part.

5. The rewinding system of claim 4, wherein:

the loading apparatus includes a loading member into which the other end of at least one of the first mounting member and the second mounting member can be inserted, and in a state in which the other end of at least one of the first mounting member and the second mounting member is inserted and connected to the loading member, the support part guides the plurality of re-winding rolls on which the thin-film tape is rewound to be pushed in a direction in which the loading member is located.

6. The rewinding system of claim 1, wherein the adsorption part includes:

a contact portion in contact with the thin-film tape; and an adsorption space that is stepped with respect to the contact portion and adsorbs and fixes one surface of the thin-film tape, wherein the fixing part moves between a spaced-apart state from the adsorption part and a fixed state in which the upper surface thereof is in contact with the lower surface of the thin-film tape being in contact with the contact portion.

7. The rewinding system of claim 1, wherein the rewinding apparatus rotates the first mounting member and the second mounting member in the same direction as a direction in which the first mounting member rotates about the shaft thereof to change the positions of the first mounting member and the second mounting member.

8. The rewinding system of claim 1, wherein the rewinding apparatus further includes a rail part connected to upper and lower sides thereof to horizontally move the rewinding apparatus.

* * * * *